United States Patent [19]

Juneau, Jr. et al.

[11] Patent Number: 4,978,400

[45] Date of Patent: Dec. 18, 1990

[54] SYNERGISTIC COMPOSITE PYROTECHNIC MATERIAL

[75] Inventors: Paul W. Juneau, Jr., Norristown; Howard Semon, Malvern, both of Pa.

[73] Assignee: General Sciences, Inc., Plymouth Meeting, Pa.

[21] Appl. No.: 439,067

[22] Filed: Nov. 17, 1989

[51] Int. Cl.[5] ..... C06G 45/02

[52] U.S. Cl. ..... 149/21; 149/22; 149/109.6; 149/110; 149/114

[58] Field of Search ..... 149/21, 22, 109.6, 110, 149/114

[56] References Cited

U.S. PATENT DOCUMENTS

| | | | |
|---|---|---|---|
| 3,899,374 | 8/1975 | Sylkhouse | 149/21 |
| 4,092,263 | 5/1978 | Zavitsanos | 252/181.4 |
| 4,145,328 | 3/1989 | Juneau, Jr. et al. | 260/30.4 R |
| 4,331,080 | 5/1982 | West et al. | 102/301 |
| 4,341,651 | 7/1982 | Beckert et al. | 149/87 |

*Primary Examiner*—Stephen J. Lechert, Jr.

*Attorney, Agent, or Firm*—Seidel, Gonda, Lavorgna & Monaco

[57] ABSTRACT

The invention provides a pyrotechnic composite and process for preparing the same, wherein the pyrotechnic composite comprises a mixture of an alkaline earth metal sulfate, particulate boron and at least one additional particulate metal which is capable of exothermically reacting with boron. The exothermic reaction between the components of the pyrotechnic composite releases a thermal radiation of at least about 300 W/cm$^2$-Steradian and a visible light energy of at least about $1.0 \times 10^4$ LUX.

57 Claims, 3 Drawing Sheets

SYNERGISTIC COMPOSITE PYROTECHNIC MATERIAL

FIELD OF THE INVENTION

This invention relates generally to pyrotechnic composites. More particularly, it relates to pyrotechnic composites formed by mixing compounds which result in an increased energy output upon reaction due to a synergistic effect of at least a portion of its components.

BACKGROUND OF THE INVENTION

As the interest in employing nuclear reactions in weapons and/or as sources of energy increases, so does the interest in determining the effects of a nuclear blast. In addition to the emission of nuclear radiation, a nuclear blast also releases a high-level, pulse of thermal radiation along with a high-intensity light energy. This pulse of thermal radiation and high-intensity light energy, generally does not last longer than a few seconds.

One method of determining the effect of a nuclear blast is by observing a nuclear explosion. For obvious reasons, however, this technique is neither economically nor environmentally feasible.

Although attempts have been made to simulate the thermal and/or luminescent effects of a nuclear blast, these attempts have been unable to satisfactorily duplicate the high-level, short duration, pulse of thermal radiation and/or high-intensity light energy emitted therefrom.

Accordingly, one object of this invention is to provide a means for simulating the short duration pulse of thermal radiation and the high-intensity light energy resulting from a nuclear blast.

Another object of the present invention is to provide a pyrotechnic composite material which, upon ignition, releases a high level of thermal radiation and a high-intensity light energy, wherein the duration period of these energy releases is not greater than a few seconds.

Equally as desirable as producing a pyrotechnic composite, which produces higher thermal and light energy releases upon ignition, is the development of a means for forming such a composite into a solid mass, whose shape, size and/or weight satisfies a specific need of the end user. While, in the past, organic binders have been employed to bind together the components of such composites, there are many problems associated therewith. For example, organic binders often act as diluents which reduce the amount of energy released upon ignition of the pyrotechnic composite. In fact, it is possible for the use of an excessive amount of some types of organic binders to completely dampen the energy releases.

Another typical problem encountered with organic binders is that they often tend to slow down the reaction mechanism between the components of the pyrotechnic composite. This results in significantly increasing the duration period of the energy releases. Moreover, organic binders, when subjected to the temperatures and conditions associated with a nuclear blast, often release gases and/or carbonaceous particles which can obscure the pulse of thermal radiation and/or light energy released upon ignition.

Therefore, another object of the present invention is to provide a means for bonding together the components of a pyrotechnic composite to form a mass which can be molded into many different desired shapes or sizes, wherein the bonding means (1) does not obscure and/or decrease the level of energy released from the pyrotechnic composite upon ignition and (2) does not slow down the reaction mechanism between the components of the pyrotechnic composite (i.e., does not increase duration period of energy releases).

Still another object of the invention is to provide a pyrotechnic composite in the form of solid bodies which have sufficient physical integrity to permit their handling without significant damage.

Yet another object of the invention is to provide a pyrotechnic composite in the form of solid bodies which have a density which is greater than comparable composite materials.

Other objects, aspects and advantageous of the present invention will be apparent to those skilled in the art upon reading the specification and the appended claims which follow.

SUMMARY OF THE INVENTION

In accordance with one embodiment of the invention, there is provided a novel pyrotechnic composite which comprises a mixture of an alkaline earth metal sulfate, particulate boron and at least one additional particulate material which is capable of exothermically reacting with boron. A reaction between the alkaline earth metal sulfate, the particulate boron and the additional particulate material results in a higher thermal and light energy release, when compared to similar pyrotechnic composites which either do not employ the use of a binder or employ the use of an organic binder.

In accordance with another embodiment of the invention, there is provided a method for forming a pyrotechnic composite into a solid mass. In this embodiment, a castable slurry is first prepared. The slurry comprises water, an alkaline earth metal sulfate, particulate boron, and at least one additional particulate material which is capable of exothermically reacting with boron. After the castable slurry is prepared, it is molded into the desired form. The molded castable slurry is then hardened to form a solid pyrotechnic composite mass.

When the alkaline earth metal sulfate, the particulate boron and the additional particulate material, of either of the above embodiments, react with one another, a high-level, short duration, pulse of thermal radiation is released. Accompanying the short duration pulse of thermal radiation is a high-intensity visible light energy release.

A more complete appreciation of the present invention and many attendant advantages thereof will be readily ascertained as the invention becomes better understood by reference to the following detailed description, when considered in connection with the accompanying figures briefly described below, and the appended claims.

DETAILED DESCRIPTION OF THE INVENTION

Figure 1A:
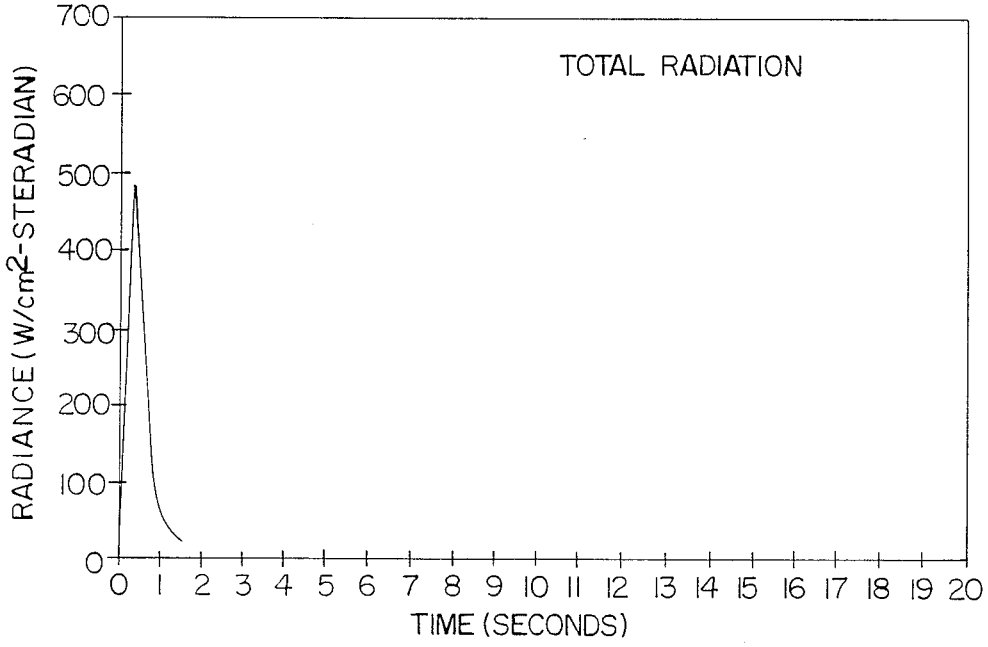
FIGS. 1*a* and 1*b* are graphs plotting the energy output of an exothermic reaction resulting from the ignition of a mixture prepared in accordance with the present invention.

When finely divided boron and at least one additional particulate material which is capable of exothermically reacting therewith (e.g., titanium) are heated to a sufficiently high temperature, an intermetallic compound is generally formed. The formation of this intermetallic compound often liberates thermal radiation and a visible light energy. The amount of thermal radiation released from this exothermic reaction is generally greater than about 300 watts per centimeter squared-Steradian ($W/cm^2$-Steradian). Moreover, the amount of light energy released from the same exothermic reaction is generally less than about $1.0\times10^4$ LUX. The duration of these energy releases is generally greater than about 2 seconds.

For some applications, the levels of thermal radiation and/or high-intensity light energy released from the aforementioned exothermic reaction are too low, while, for other applications, the duration of the pulse of thermal radiation is too long. A specific example where these short comings are most noticeable is when the desired application is that of simulating the thermal and luminescent effects of a nuclear blast.

In addition to its release of nuclear radiation, a nuclear blast also has associated therewith a release of thermal radiation which is generally greater than about 300 $W/cm^2$-Steradian. Moreover, the release of light energy associated with a nuclear blast is generally greater than about $1.0\times10^4$ LUX. Finally, during a nuclear blast, the duration of the thermal and light energy releases is generally less than about 2 seconds.

The present invention is concerned with the use of additives to a boron-containing pyrotechnic composite in order to (1) increase the level of thermal and light energy released therefrom upon ignition and/or (2) decrease the duration period of these energy releases.

The present invention comprises a novel pyrotechnic composite and a process for forming the same into a solid mass. The invention further comprises a method of producing a high-level, short duration, pulse of thermal radiation, accompanied by the release of a high-intensity light energy.

As employed herein, the phrase "high-level", when used to identify the amount of thermal radiation released, refers to a pulse of thermal radiation which is at least about 300 $W/cm^2$-Steradian.

As employed herein, the phrase "high-intensity", which identifies the amount of light energy released, refers to a light energy release which is at least about $1.0\times10^4$ LUX.

As employed herein, the phrase "short-duration", when used to identify the length of time over which the pulse of thermal radiation and light energy is released, refers to a time period which is generally less than about 2 seconds, preferably, less than about 1.9 seconds, and more preferably, less than about 1.8 seconds.

The novel pyrotechnic composite comprises a mixture of an alkaline earth metal sulfate, particulate boron, and at least one additional particulate material which is capable of exothermically reacting with boron. When the novel pyrotechnic composite is ignited, a high-level, short duration, pulse of thermal radiation is released. Accompanying this release of thermal radiation is the release of a high-intensity light energy.

The thermal radiation released from the ignition of the novel pyrotechnic composite is generally greater than about 300 $W/cm^4$-Steradian. The light energy released from the ignition of the novel pyrotechnic composite is generally greater than about $1.0\times10^4$ LUX. The duration period of these energy releases is generally less than about 2 seconds.

When practicing the invention, any suitable alkaline earth metal sulfate can be blended with the particulate boron and the additional particulate material which, upon ignition of the novel pyrotechnic composite, results in (1) increasing the amount of thermal radiation and/or light energy released and/or (2) decreasing the duration period at least one of these energy releases. Examples of suitable alkaline earth metal sulfates include, but are not limited to, hydrated beryllium sulfate, hydrated magnesium sulfate, heptahydrate magnesium sulfate, dihydrate calcium sulfate, hemihydrate calcium sulfate, and sulfates of other Group II A metals which form suitable binders for the components of a pyrotechnic composite mixture. Such other materials include strontium, barium and/or mixtures thereof. Generally the alkaline earth metal sulfate component of the novel pyrotechnic composite comprises at least one compound selected from the group consisting of dihydrate calcium sulfate, hemihydrate calcium sulfate, hydrated magnesium sulfate, hydrated barium sulfate and mixtures thereof. Preferably, the alkaline earth metal sulfate component comprises hemihydrate calcium sulfate.

If the alkaline earth metal sulfate employed when practicing the invention comprises hemihydrate calcium sulfate, it is presently preferred that the novel pyrotechnic composite further comprises water. It should be noted, however, that water may also be present when employing any of the other suitable alkaline earth metal sulfates.

In the instance where water is included as a component of the novel pyrotechnic composite and where the alkaline earth metal sulfate comprises hemihydrate calcium sulfate, the water should be present in at least an amount which causes at least a partial hydration of the hemihydrate calcium sulfate. Generally, the weight ratio of the water component to the hemihydrate calcium sulfate component is at least about 1:5.5. Preferably, the weight ratio of the water to the hemihydrate calcium sulfate ranges from about 1:5.5 to about 1:1, more preferably, from about 1:5.5 to about 1:3.

In addition to an alkaline earth metal sulfate, the novel pyrotechnic composite further comprises particulate boron and at least one additional particulate material which can exothermically react therewith. Generally, the particulate boron and the additional particulate material are substantially in elemental form and contain little, if any, oxides and/or other compounds.

The at least one additional particulate material which is capable of exothermically reacting with boron can be any suitable material which, when interacting with the particulate boron and the alkaline earth metal sulfate, results in the release of a high-level, short duration, pulse of thermal radiation with an accompanying release of high-intensity light energy. Examples of such additional particulate material components include, but are not limited to titanium, magnesium, hafnium, zirconium, tantalum, carbon, or uranium, and/or mixtures thereof. It is presently preferred that the additional particulate material component comprises at least one material selected from the group consisting of titanium, tantalum, zirconium, magnesium and carbon. In an even more preferred embodiment, the additional particulate material component comprises titanium.

The molar ratio of the particulate boron component to the additional particulate material component should be sufficient to result in the formation of a solid intermetallic compound. While it is presently preferred that the particulate boron component and the additional particulate material component be present in the stoichiometric proportions required to form such an intermetallic compound, it is, nevertheless, also within the scope of the invention to have an excess amount of either boron or the additional particulate material. For example, the molar ratio of the boron component to the additional particulate material component can range from about 1.8:1 to about 2.2:1, and even from about 1.5:1 to about 2.5:1.

There is no limit as to the minimum amount of alkaline earth metal sulfate which can be employed when practicing the invention, except that it should be present in an amount which is at least sufficient to (1) increase the level of thermal radiation and/or high-intensity light energy released upon ignition of the novel pyrotechnic composite and/or (2) decrease the duration period of these energy releases. While there is no limit as to the maximum amount of alkaline earth metal sulfate which can be employed, for practical purposes, it is generally present in an amount below that which partially dampens the levels of energy released upon ignition of the novel pyrotechnic composite. Preferably, the ratio of (a), the weight of the sum of the boron component and the additional particulate material component, to (b), the weight of the alkaline earth metal sulfate component, ranges from about 95:5 to about 40:60; more preferably, from about 92:8 to about 70:30; and even more preferably, from about 90:10 to about 75:25.

The particulate boron component and the additional particulate material component are not limited to any specific particle diameter as long as these components are in sufficiently intimate contact such that a solid-to-solid reaction can occur. For practical purposes, however, the particle diameter of the boron component is such that at least 75 volume percent of the particles are less than about 40 microns. Generally, at least 75 volume percent of the boron particles range from about 5 microns to about 30 microns, preferably from about 10 microns to about 20 microns.

The particle diameters of the additional particulate material component can be larger and/or coarser than the particles of the boron component. Generally, the particle diameter of the additional particulate material is such that at least 75 volume percent of the particles are less than about 50 microns. Preferably, at least 75 volume percent of the particles of the additional particulate material range from about 10 microns to about 45 microns, and more preferably, from about 20 microns to about 40 microns.

High purity components are generally preferred when preparing the novel pyrotechnic composite material of the present invention. Impurities can promote side reactions and can create stoichiometric imbalances which may result in less than the desired amount of energy release.

Any conventional ignition means or device can be employed to initiate the exothermic reaction between the components of the novel pyrotechnic composite. Examples of conventional ignition means which can be employed when practicing this invention include, but are not limited to, impact sensitive starters, electrical fuses, EXO® braid, hot wire, percussion cap, safety fuse, electric arc, or any other means of achieving an ignition temperature of at least about 630° C. The presently preferred means for initiating the exothermic reaction between the components of the novel pyrotechnic composite comprises the implementation of EXO® braid, fired by an electric current of at least about 20 amps at about a 9 volt minimum.

The novel pyrotechnic composite of the present invention can be compounded, mixed, and/or formulated in any manner known to those skilled in the art. While the components of the novel composite material can be blended dry and used as such, in many specific applications it is desirable for a composite material to be in the form of a solid mass whose shape, size and weight satisfy a specific need. As stated earlier, binders (e.g., resinous adhesives) can be used to join together the various components of a composite material. Any such binders can be used when practicing the invention.

However, as was also stated earlier, in some instances, it is desirable that the size and weight of a pyrotechnic composite be as compact as possible. Since the prior art binders (e.g., resinous adhesives and organic binders) do not increase the amount of thermal and/or light energy released from the ignition of a pyrotechnic composite, the use of such binders are not preferred if size and/or weight limitations are critical.

The present invention further provides a novel method for minimizing the size and weight of the novel pyrotechnic composite. Specifically, the present invention utilizes the alkaline earth metal sulfate as a binder as well as a component which contributes to the increased energy releases. By utilizing one component for two different functions, the size and weight of the resulting pyrotechnic body can be minimized.

In one example of a method for preparing a pyrotechnic composite in accordance with the present invention, a castable slurry is prepared. This castable slurry comprises water, the alkaline earth metal sulfate, the particulate boron, and the at least one additional particulate material. After the castable slurry is prepared, it can be molded to the desired shape. Once molded, the castable slurry is generally permitted to harden.

Any suitable technique, which does not result in initiating the exothermic reaction between the components of the pyrotechnic composite material, can be employed to harden the molded castable slurry comprising the novel pyrotechnic composite. Examples of such suitable methods include, but are not limited to, air drying, baking in an oven at temperatures below about 200° C., vacuum drying, and/or baking in an inert atmosphere at a temperature below about 200° C. The presently preferred method for hardening the mold is to allow the pyrotechnic body to harden at ambient temperature, followed by baking in an air oven maintained at a temperature in the range from about 100° C. to about 150° C.

The hardening process can be accelerated by the addition of foreign material. One example of a suitable foreign material is sand.

Reinforcement materials can also be incorporated into the novel pyrotechnic composite body. Examples of suitable reinforcement materials include, but are not limited to, micro flakes, inorganic fibers (e.g., glass and silica), and the like and/or mixtures thereof.

Also provided by the present invention is a method for producing a high-level, short duration, pulse of thermal radiation with an accompanying release of a high-intensity light energy. Specifically, by initiating the exothermic reaction between the components of the novel pyrotechnic composite, a high-level, short duration, pulse of thermal radiation is released which is accompanied by the release of a high-intensity light energy.

Uses for pyrotechnic composite made in accordance with the present invention depend upon the energy forms desired (e.g., incendiary, infrared light or visible light). Due to the high level of thermal radiation and the high-intensity light energy released from the exothermic reaction between the components of the novel pyrotechnic composite, this composition is especially useful for use as a simulation of nuclear blasts and/or the fire-balling effects of nuclear explosions. As such, it can be used to determine the structural integrity of buildings, vehicles, etc., when subjected to the thermal and/or luminescent effects which accompany a nuclear blast.

Furthermore, due to the extremely high level of thermal radiation released therefrom, another possible use of the novel pyrotechnic composite is as a means of demolition. Moreover, due to the high-intensity light energy released therefrom, the novel composite can also be employed as fireworks.

It should be noted, however, that the above are merely examples of uses for the novel pyrotechnic composite. A pyrotechnic composite prepared in accordance with this invention can be used for any application where there is a need for the release of a high-level, short duration, pulse of thermal radiation or the release of a high-intensity light energy or both.

The example which follows is intended to assist in a further understanding of the invention. Particular materials employed, species and conditions recited therein are intended to be illustrative of the invention and not limitative of the reasonable scope thereof.

EXAMPLE I

This example compares the thermal and luminescent energy releases of a pyrotechnic composite prepared in accordance with the invention to those of standard pyrotechnic composites known in the industry.

The pyrotechnic composite prepared in accordance with this invention comprises a mixture of an alkaline earth metal sulfate, particulate boron and at least one additional metal which is capable of exothermically reacting with boron. In this example, the alkaline earth metal sulfate was hemihydrate calcium sulfate (i.e., plaster of paris) and was commercially available as UGL ® Plaster of Paris from United Gilsonite Laboratories of Scranton, Pa.; the particulate boron had a mean particle diameter distribution of about 10 to about 20 microns and was commercially available as Boron from Callery, Inc of Callery, Pa.; and, the additional particulate material component was titanium which had a mean particle diameter of about 20 to about 40 microns and was commercially available as Titanium Metal Grade A from Consolidated Astronautics of Hauppauge, N.Y.

When preparing the pyrotechnic composite in accordance with the present invention, 21 grams (2 moles) of particulate boron, 48 grams (1 mole) of particulate titanium, 15 grams (0.1 moles) hemihydrate calcium sulfate and 90 grams (5 moles) of tap water were blended together until a homogeneous slurry was formed. A portion of the slurry was molded into a pyrotechnic body having the dimensions of approximately 2 inches wide by 3 inches long by 1 inch thick.

EXO TM braid wires were embedded into the slurry prior to the slurry being subjected to a hardening process.

After the EXO TM braid wires were embedded therein, the slurry was hardened by being subjected to ambient temperature for about 18 hours. The hardened pyrotechnic composite was then baked in an air oven maintained at a temperature of about 125° C. for about 6 hours. Hereinafter, this pyrotechnic body will be referred to as Sample 1.

After Sample 1 had been formed, the exothermic reaction between its components was initiated by firing the EXO TM braid wires by an electric current of 20 amps at 9 volts.

The initiation of the exothermic reaction between the components of Sample 1 resulted in the release of thermal radiation and light energy.

The amount of thermal radiation released was measured by a Pyroelectric Radiometer in the wavelength band region of 0.4–20 microns and was recorded in units of watts per centimeter squared Steradian ($W/cm^2$-Steradian) as a function of time. These data are plotted on the graph in FIG. 1*a*.

The amount of visible light released was measured by Photodiode Detector in the wavelength band region of 0.4–0.7 microns and was recorded in units of LUX as a function of time. These data are plotted on the graph in FIG. 1*b*.

FIG. 1*a* demonstrates that a peak radiance of about 490 $W/cm^2$-Steradian was released approximately 0.5 seconds after the initiation of the exothermic reaction between the components of Sample 1. The release of thermal radiation continued for a period of approximately 1.25 seconds.

Figure 1B:
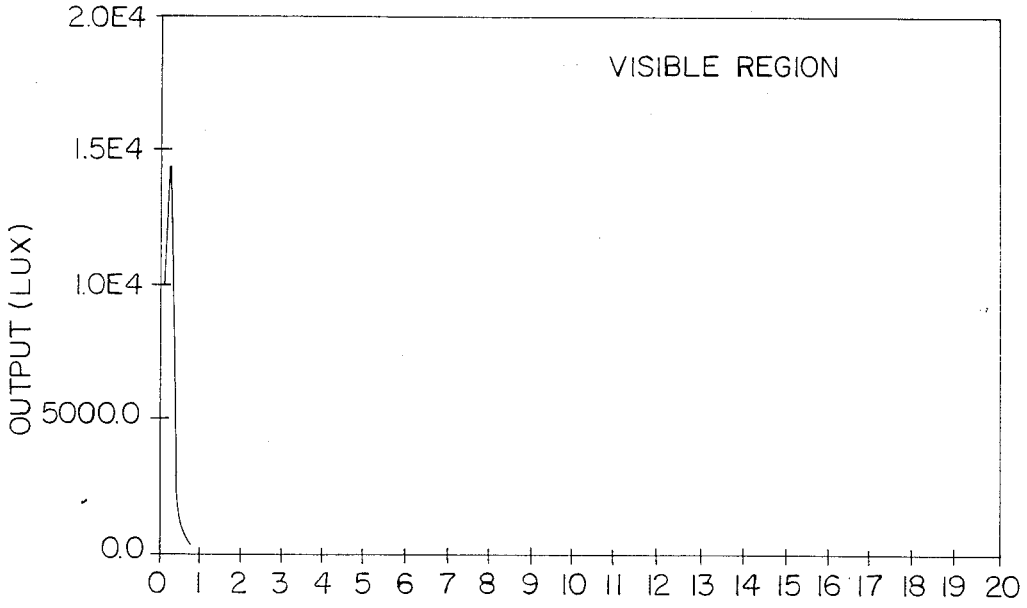

FIG. 1*b*, on the other hand, demonstrates that a visible light output of about $1.49\times10^4$ LUX was released approximately 0.25 seconds after the initiation of the exothermic reaction between the components of Sample 1. The release of light energy continued for a period of approximately 0.75 seconds.

For comparative purposes, two additional samples of a pyrotechnic composite (i.e., Samples 2 and 3, inclusive) were prepared.

The first control sample (i.e., Sample 2) was prepared by blending 21 grams (2 moles) of particulate boron, 48 grams (1 mole) of particulate titanium, and 5 grams of an organic binder dissolved in 90 grams (5 moles) of distilled water. These components were blended until a homogeneous slurry was formed. The particulate boron and particulate titanium used in the preparation of Sample 2 were the same as those used in the preparation of Sample 1. The organic binder used in the preparation of Sample 2 was methylcellulose ether, commercially available as METHOCEL ® from Dow Chemical Co. of Midland, Mich.

After the homogeneous slurry containing the components of Sample 2 was formed, a portion of the slurry was molded into a pyrotechnic body having the dimensions of approximately 2 inches wide by 3 inches long by 1 inch thick. As in the preparation of Sample 1, EXO TM braid wires were then embedded into the slurry containing the components of Sample 2 prior to the slurry being subjected to a hardening process. After the EXO TM braid wires were embedded therein, the slurry containing the components of Sample 2 was hardened by being subjected to ambient temperature for about 18 hours. The hardened pyrotechnic composite was then baked in an air oven maintained at a temperature of about 125° C. for about 6 hours.

The second control sample (i.e., Sample 3) was prepared by blending 21 grams (2 moles) of particulate boron with 48 grams (1 mole) of particulate titanium. The particulate boron and particulate titanium used in the preparation of Sample 3 were the same as those employed in the preparation of Sample 1. Sample 3 was a homogeneous mixture of particulate boron and particulate titanium. Sample 3 did not employ the use of any binder material.

After the homogeneous mixture containing the components of Sample 3 was prepared, EXO TM braid wires were embedded into the dry mixture.

After comparative Samples 2 and 3 were prepared, the exothermic reaction between the components comprising the respective Samples was initiated by firing the EXO TM braid wires by an electric current of 20 amps at 9 volts. The initiation of the exothermic reaction between the components of Samples 2 and 3 resulted in the release of thermal radiation and light energy. The amount of thermal radiation and light energy released there from were determined by the same procedures employed with Sample 1. The data associated with the release of thermal radiation and light energy resulting from the ignition of Sample 2 are plotted on the graphs in FIGS. 2*a* and 2*b*, respectively.

Figure 2A:
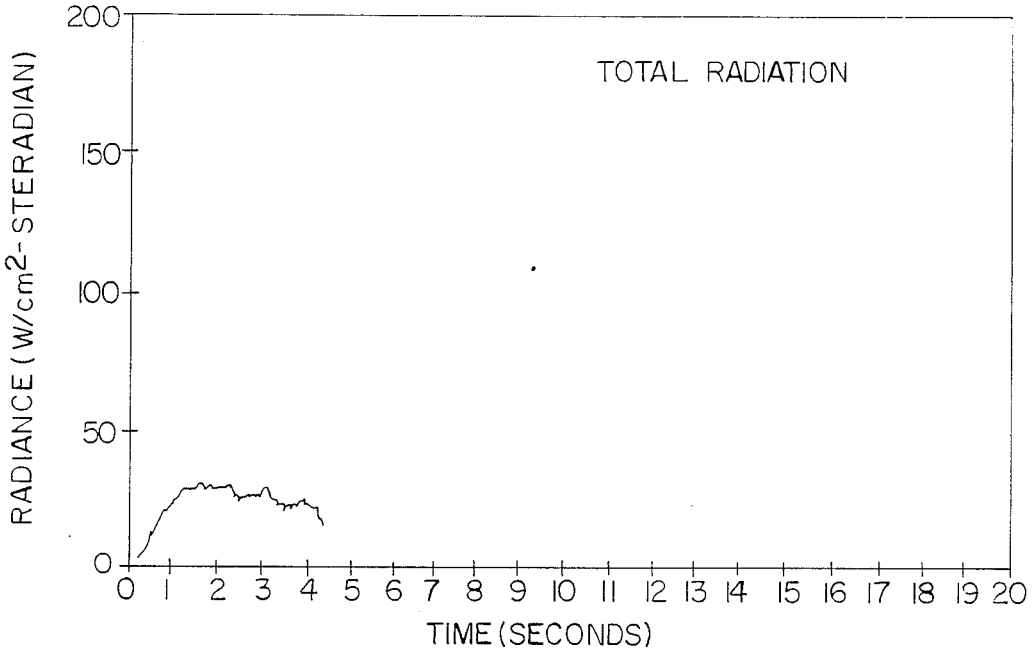
FIGS. 2*a* and 2*b* are graphs plotting the energy output of an exothermic reaction resulting from the ignition of a mixture wherein neither a binder nor an alkaline earth metal sulfate is present.

FIG. 2*a* demonstrates that a peak radiance of about 30 W/cm$^2$-Steradian was released approximately 1.8 seconds after the initiation of the exothermic reaction between the components of Sample 2. The release of thermal radiation continued for a period of approximately 5 seconds.

Figure 2B:
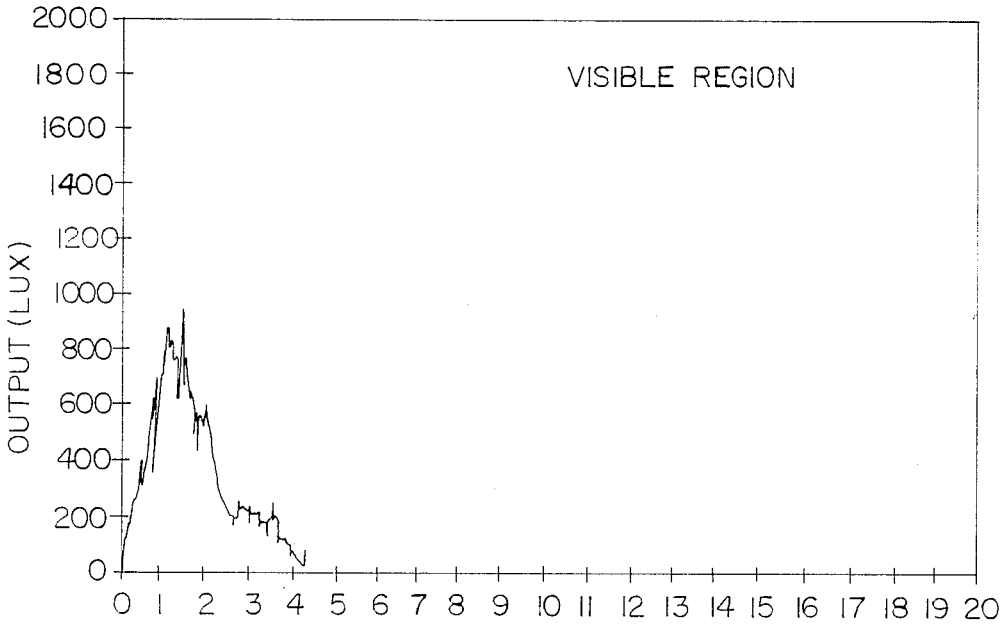

FIG. 2*b*, on the other hand, demonstrates that a visible light output of about $1.95\times10^3$ LUX was released approximately 1.6 seconds after the initiation of the exothermic reaction between the components of Sample 2. The release of light energy continued for a period of approximately 4.25 seconds.

As can be seen from the above data, the thermal radiation and light energy released from the exothermic reaction between the components of Sample 1 are significantly greater than those released from the initiation of the exothermic reaction between the components of Sample 2. The data further demonstrates that the duration period over which the thermal radiation and light energy is released from the exothermic reaction between the components of Sample 1 is significantly less than that from the initiation of the exothermic reaction between the components of Sample 2 (compare, FIGS. 1*a* with 2*a* and 1*b* with 2*b*, respectively).

Figure 3A:
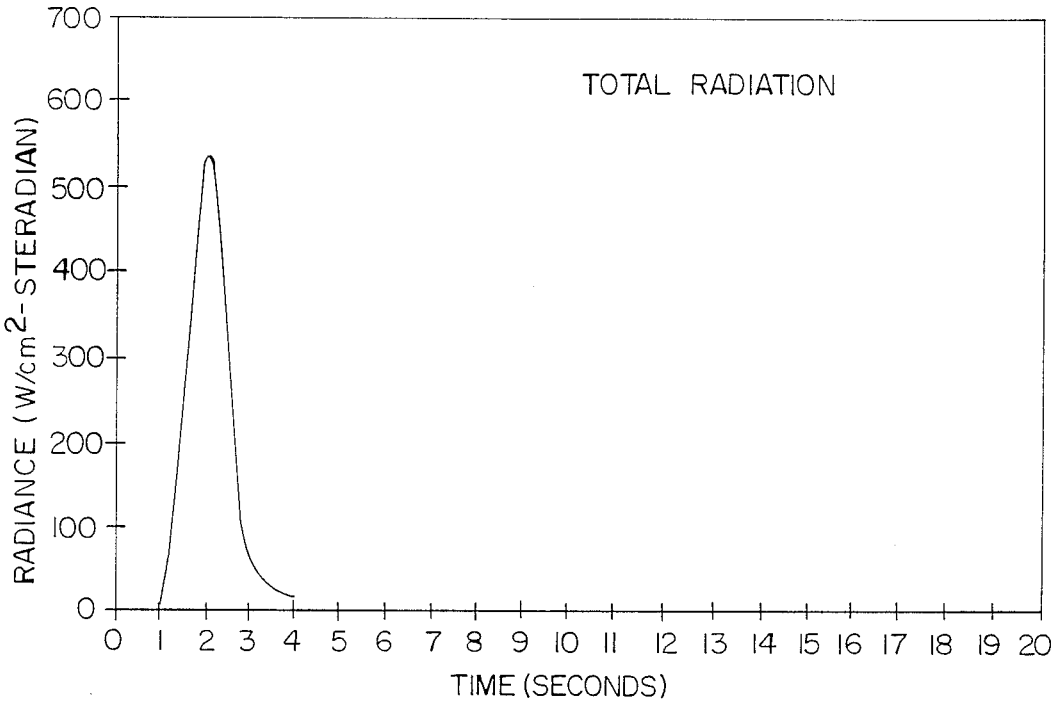
FIGS. 3*a* and 3*b* are graphs plotting the energy output of an exothermic reaction resulting from the ignition of a mixture wherein an organic binder is present; but, an alkaline earth metal sulfate is not present.

The data associated with the release of thermal radiation and light energy resulting from the ignition of Sample 3 are plotted on the graphs in FIGS. 3*a* and *3*b, respectively.

FIG. 3*a* demonstrates that a peak radiance of about 530 W/cm$^2$-Steradian was released approximately 2 seconds after the initiation of the exothermic reaction between the components of Sample 3. The release of thermal radiation continued for a period of approximately 3 seconds.

Figure 3B:
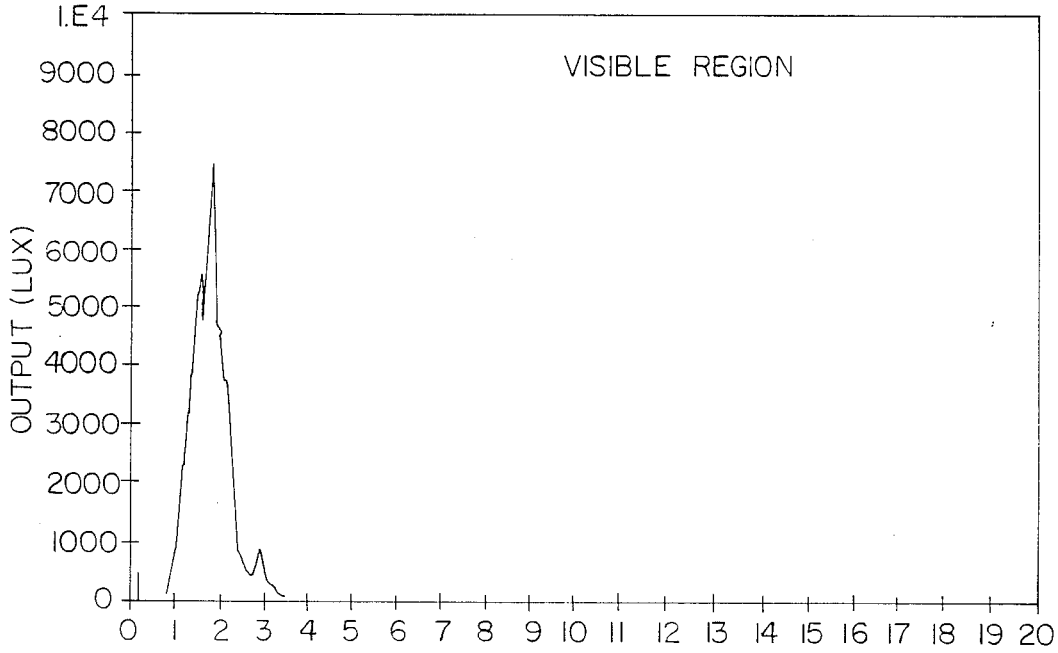

FIG. 3*b*, on the other hand, demonstrates that a visible light output of about $7.50\times10^3$ LUX was released approximately 1.75 seconds after the initiation of the exothermic reaction between the components of Sample 3. The release of light energy continued for a period of approximately 2.1 seconds.

The above data demonstrates that, without significantly decreasing the amount of thermal radiation released, the initiation of the exothermic reaction between the components of Sample 1 resulted in a release of visible light energy which is significantly greater than that observed when initiating the exothermic reaction between the components of Sample 3. The data further demonstrates that the duration of energy releases observed during the initiation of the exothermic reaction between the components of Sample 1 is significantly less than that observed when initiating the exothermic reaction between the components of Sample 3 (compare. FIGS.1*a* with 3*a* and 1*b* with 3*b*, respectively).

It is evident from the foregoing that various modifications, which are apparent to those skilled in the art, can be made to the embodiments of this invention without departing from the spirit and/or scope thereof. Having thus described the invention, it is claimed as follows.

That which is claimed is:

1. A pyrotechnic composite comprising a mixture of an alkaline earth metal sulfate, particulate boron and at least one additional particulate material which is capable of exothermically reacting with boron to yield an intermetallic compound, wherein at least 75 volume percent of said particulate boron has a diameter of less than about 40 microns, wherein at least 75 volume percent of said at least one additional particulate material has a diameter of less than about 50 microns, and wherein an exothermic reaction between said alkaline earth metal sulfate, said particulate boron and said at least one particulate material results in a release of thermal radiation of at least about 300 W/cm$^2$-Steradian and a release of visible light energy of at least about $1.0\times10^4$ LUX.

2. A composition as in claim 1 wherein said alkaline earth metal sulfate comprises at least one compound selected from the group consisting of hydrate beryllium sulfate, hydrate magnesium sulfate, heptahydrate magnesium sulfate, dihydrate calcium sulfate, hemihydrate calcium sulfate, and mixtures thereof.

3. A composition as in claim 1 wherein said alkaline earth metal sulfate comprises at least one compound selected from the group consisting of dihydrate calcium sulfate, hemihydrate calcium sulfate, and mixtures thereof.

4. A composition as in claim 1 wherein said alkaline earth metal comprises hemihydrate calcium sulfate.

5. A composition as in claim 4 wherein said pyrotechnic composite further comprises water and wherein said water is present in an amount which is at least sufficient to hydrate at least a portion of said hemihydrate calcium sulfate.

6. A composition as in claim 5 wherein the weight ratio of said water to said hemihydrate calcium sulfate is at least about 1:5.5.

7. A composition as in claim 6 wherein said weight ratio of said water to said hemihydrate calcium sulfate ranges from about 1:5.5 to about 1:1.

8. A composition as in claim 7 wherein said weight ratio of said water to said hemihydrate calcium sulfate ranges from about 1:5.5 to about 1:3.

9. A composition as in claim 1 wherein said alkaline earth metal sulfate comprises dihydrate calcium sulfate.

10. A composition as in claim 1 wherein said at least said one additional particulate material comprises at least one element selected from the group consisting of titanium, lithium, hafnium, zirconium, tantalum, uranium, and mixtures thereof.

11. A composition as in claim 1 wherein said at least one additional particulate material comprises titanium.

12. A composition as in claim 1 wherein at least 75 volume percent of said particulate boron has a diameter ranging from about 5 to about 30 microns.

13. A composition as in claim 12 wherein at least 75 volume percent of said particulate boron has a diameter ranging from about 10 to about 20 microns.

14. A composition as in claim 1 wherein at least 75 volume percent of said at least one additional particulate material has a diameter ranging from about 10 to about 45 microns.

15. A composition as in claim 14 wherein at least 75 volume percent of said at least one additional particulate material has a diameter ranging from about 20 to about 40 microns.

16. A composition as in claim 12 wherein at least 75 volume percent of said at least one additional particulate material has a diameter ranging from about 10 to about 45 microns.

17. A composition as in claim 16 wherein said alkaline earth metal sulfate comprises hemihydrate calcium sulfate and wherein said at least one additional particulate material comprises titanium.

18. A composition as in claim 17 wherein said pyrotechnic composite further comprises water and wherein said water is present in an amount which is at least sufficient to hydrate at least a portion of said hemihydrate calcium sulfate.

19. A composition as in claim 16 wherein said alkaline earth metal sulfate comprises dihydrate calcium sulfate and wherein said at least one additional particulate material comprises titanium.

20. A composition as in claim 19 wherein said molar ratio of said particulate boron to said at least one additional particulate material ranges from about 1.5:1 to about 2.5:1.

21. A composition as in claim 1 wherein the molar ratio of said particulate boron to said at least one additional particulate material ranges from about 1.8:1 to about 2.2:1.

22. A composition as in claim 21 wherein said particulate boron and said at least one additional particulate material are present in substantially stoichiometric proportions required for the formation of said intermetallic compound.

23. A composition as in claim 1 wherein the ratio of (a), the weight of the sum of said particulate boron and said at least one additional particulate material to (b), the weight of said alkaline earth metal sulfate, ranges from about 95:5 to about 40:60.

24. A composition as in claim 23 wherein the ratio of (a), the weight of the sum of said particulate boron and said at least one additional particulate material to (b), the weight of said alkaline earth metal sulfate, ranges from about 92:8 to about 70:30.

25. A composition as in claim 24 wherein the ratio of (a), the weight of the sum of said particulate boron and said at least one additional particulate material to (b), the weight of said alkaline earth metal sulfate, ranges from about 90:10 to about 75:25.

26. A composition as in claim 1 further comprising a means for initiating an exothermic reaction between said particulate boron and said at least one additional particulate material.

27. A composition as in claim 26 wherein said means for initiating said exothermic reaction comprises at least one means selected from the group consisting of impact sensitive starters, electrical fuses, EXO® braid, hot wire, percussion cap, safety fuse and electric arc.

28. A composition as in claim 27 wherein said means for initiating said exothermic reaction comprises EXO® braid fired by an electric current of at least about 20 amps at about a 9 volt minimum.

29. A method for preparing a pyrotechnic composite body comprising the steps of:

(a) preparing a castable slurry comprising water, an alkaline earth metal sulfate, particulate boron, and at least one additional particulate material which is capable of exothermically reacting with boron to yield an intermetallic compound, wherein at least 75 volume percent of said particulate boron has a diameter of less than about 40 microns, wherein at least 75 volume percent of said particulate boron has a diameter of less than about 50 microns, and wherein an exothermic reaction between said hydrate alkaline earth metal sulfate, said particulate boron and said at least one additional particulate material results in a release of thermal radiation of at least about 300 $W/cm^2$-Steradian and a release of visible light energy of at least about $1.0\times10^4$ LUX, (b) molding said castable slurry, and (c) hardening said castable slurry to form said pyrotechnic composite body.

30. A method as in claim 29 wherein said alkaline earth metal sulfate comprises at least one compound selected from the group consisting of hydrate beryllium sulfate, hydrate magnesium sulfate, heptahydrate magnesium sulfate, dihydrate calcium sulfate, hemihydrate calcium sulfate, and mixtures thereof.

31. A method as in claim 30 wherein said alkaline earth metal sulfate comprises dihydrate calcium sulfate.

32. A method as in claim 30 wherein said alkaline earth metal sulfate comprises hemihydrate calcium sulfate.

33. A method as in claim 29 wherein said at least one additional particulate material comprises at least one element selected from the group consisting of lithium, titanium, hafnium, zirconium, tantalum, uranium, and mixtures thereof.

34. A method as in claim 33 wherein said at least one additional particulate material comprises titanium.

35. A method as in claim 29 wherein at least 75 volume percent of said particulate boron has a circumferential dimension ranging from about 5 to about 30 microns.

36. A method as in claim 29 wherein at least 75 volume percent of said at least one additional particulate material has a diameter ranging from about 10 to about 45 microns.

37. A method as in claim 29 wherein said castable slurry is prepared by mixing together said water, said alkaline earth metal sulfate, said particulate boron, and said at least one additional particulate material, and wherein the weight ratio of said particulate boron to said at least one additional particulate material ranges from about 1:5.5 to about 2.5:1.

38. A method as in claim 37 wherein the ratio of (a), the weight of the sum of said particulate boron and said at least one additional particulate material, to (b), the weight of said alkaline earth metal sulfate, ranges from about 95:5 to about 40:60.

39. A method as in claim 38 wherein the weight ratio of said alkaline earth metal sulfate to said water is at least about 1:5.5.

40. A method as in claim 29 further comprising the step of incorporating a means for initiating an exothermic reaction between said particulate boron and said at least one additional particulate material.

41. A method as in claim 40 wherein said means for initiating said exothermic reaction comprises at least one means selected from the group consisting of input sensitive starters, electric fuses, EXO ® braid, hot wire, percussion cap, safety fuse and electric arc.

42. A method for producing a high level, short duration pulse of radiation comprising the steps of:

(a) preparing a pyrotechnic composite comprising a mixture of an alkaline earth metal sulfate, particulate boron and at least one additional particulate material which is capable of exothermically reacting with boron to yield an intermetallic compound, wherein at least 75 volume percent of said particulate boron has a diameter of less than about 40 microns, and wherein at least 75 volume percent of said at least one additional particulate material has a diameter of less than about 50 microns, and (b) initiating an exothermic reaction between said particulate boron and said at least one additional particulate material, wherein said exothermic reaction is accompanied by a release of thermal radiation of at least about 300 $W/cm^2$-Steradian and a release of visible light energy release of at least about $1.0\times10^4$ LUX.

43. A method as in claim 42 wherein at least 75% of said exothermic reaction is completed less than about 2 seconds after initiation.

44. A method as in claim 43 wherein at least 75% of said exothermic reaction is completed less than about 1.9 seconds after initiation.

45. A method as in claim 44 wherein at least 75% of said exothermic reaction is completed less than about 1.8 seconds after initiation.

46. A method as in claim 42 wherein said pyrotechnic composite is prepared by a method comprising the steps of:

(a) preparing a castable slurry comprising water, said alkaline earth metal sulfate, said particulate boron, and said at least one additional particulate material, (b) molding said castable slurry, and (c) hardening said castable slurry.

47. A method as in claim 46 wherein the weight ratio of said water to said alkaline earth metal sulfate is at least about 1:5.5.

48. A method as in claim 46 wherein said method for preparing said pyrotechnic composite further comprises incorporating a means for initiating said exothermic reaction.

49. A method as in claim 42 wherein said alkaline earth metal sulfate comprises at least one compound selected from the group consisting of hydrate beryllium sulfate, hydrate magnesium sulfate, heptahydrate magnesium sulfate, dihydrate calcium sulfate, hemihydrate calcium sulfate, and mixtures thereof.

50. A method as in claim 46 wherein said alkaline metal sulfate comprises dihydrate calcium sulfate.

51. A method as in claim 49 wherein said alkaline earth metal sulfate comprises hemihydrate calcium sulfate.

52. A method as in claim 42 wherein said at least one additional particulate material comprises at least one element selected from the group consisting of lithium, titanium, hafnium, zirconium, tantalum, uranium, and mixtures thereof.

53. A method as in claim 42 wherein at least 75 volume percent of said particulate boron has a diameter ranging from about 5 to about 30 microns.

54. A composition as in claim 42 wherein at least 75 volume percent of said at least one additional particulate material has a diameter ranging from about 10 to about 45 microns.

55. A method as in claim 42 wherein the weight ratio of said particulate boron to said at least one additional particulate material ranges from about 1:5.5 to about 2.5:1.

56. A method as in claim 42 wherein the ratio of (a), the weight of the sum of said particulate boron and said at least one additional particulate material to (b), the weight of said alkaline earth metal sulfate, ranges from about 95:5 to about 40:60.

57. A method as in claim 46 wherein said alkaline earth metal sulfate comprises hemihydrate calcium sulfate, wherein said at least one additional particulate material comprises titanium, wherein the weight ratio of said water to said hemihydrate calcium sulfate is in the range from about 1:5.5 to about 2.5:1, wherein the ratio of (a), the weight of the sum of said particulate boron and said particulate titanium, to (b), the weight of said hemihydrate calcium sulfate, ranges from about 95:5 to about 40:60, and wherein at least 75% of said exothermic reaction is complete in less than about 2 seconds.

* * * * *